US006190769B1

(12) United States Patent
Wang

(10) Patent No.: US 6,190,769 B1
(45) Date of Patent: Feb. 20, 2001

(54) ABRASIVE FILAMENTS OF PLASTICIZED POLYAMIDES

(75) Inventor: Teh-Chuan Wang, Parkersburg, WV (US)

(73) Assignee: E. I. du Pont de Nemours and Company, Wilmington, DE (US)

( * ) Notice: Under 35 U.S.C. 154(b), the term of this patent shall be extended for 0 days.

(21) Appl. No.: 09/253,686

(22) Filed: Feb. 19, 1999

(51) Int. Cl.[7] ..... D02G 3/00

(52) U.S. Cl. ..... 428/372; 428/397; 428/400; 428/401; 428/402

(58) Field of Search ..... 428/372, 397, 428/400, 401, 402

(56) References Cited

U.S. PATENT DOCUMENTS

| | | | | |
|---|---|---|---|---|
| 3,359,235 | | 12/1967 | Brignac et al. | 260/45.75 |
| 3,522,342 | | 7/1970 | Nungesser et al. | 264/210 |
| 4,459,337 | | 7/1984 | Hansen | 428/395 |
| 4,507,361 | | 3/1985 | Twilley et al. | 428/373 |
| 4,515,858 | | 5/1985 | Bayan | 428/364 |
| 4,585,464 | | 4/1986 | Haylock et al. | 51/298 |
| 4,801,633 | * | 1/1989 | Mason et al. | 524/98 |
| 5,082,610 | | 1/1992 | Fish, Jr. et al. | 264/80 |
| 5,460,883 | | 10/1995 | Barber, Jr. et al. | 428/370 |

FOREIGN PATENT DOCUMENTS

| | | |
|---|---|---|
| 1182672 | 2/1985 | (CA) . |
| 1235249 | 4/1988 | (CA) . |
| 51 961 | 11/1966 | (DE) . |
| 322838 | 7/1985 | (EP) . |
| 56-073114 | 6/1981 | (JP) . |
| 61-076279 | 4/1986 | (JP) . |
| 61-125777 | 6/1986 | (JP) . |
| 62-039184 | 2/1987 | (JP) . |
| 62-170515 | 7/1987 | (JP) . |
| 61-36258 | 5/1994 | (JP) . |
| 7-090719 | 4/1995 | (JP) . |

* cited by examiner

*Primary Examiner*—Ana Woodward

(57) ABSTRACT

The monofilament of this invention is a polyamide of polyhexamethylene adipamide oriented from 1.0–4.0 times its original length, has a diameter of 400–1600 microns and contains 2–20% by weight, based on the weight polyamide of the monofilament, of an alkyl aryl sulfonamide plasticizer and 5.0–40.0% by weight, based on the weight of the monofilament, of abrasive particles having a particle size of 10–400 microns. These monofilaments are particularly useful as bristles used in brushes that are operated under dry conditions at relatively high temperatures.

5 Claims, No Drawings

ABRASIVE FILAMENTS OF PLASTICIZED POLYAMIDES

BACKGROUND OF THE INVENTION

This invention is directed to plasticized polyamide monofilaments containing abrasive particles that are useful as bristles in brushes used for example for polishing a wide variety of materials.

Polyamides and other thermoplastic polymers have been used to form monofilaments containing an abrasive filler and the monofilaments have been used widely for bristles in brushes used for polishing metals and electronic parts. U.S. Pat. No. 3,522,342 issued Jul. 28, 1970 to Nungesser et al shows an apparatus and process for making such monofilaments. U.S. Pat. No. 4,507,361 issued Mar. 26, 1985 to Twilley et al shows low moisture absorption bristles of blends of polyamides and polyesters containing an abrasive filler. U.S. Pat. No. 4,585,464 issued Apr. 29, 1986 to Haylock et al shows low moisture absorption abrasive bristles of polybutylene terephthalate.

In the polishing of parts under dry conditions temperature resistance rather than moisture absorption is critical in maintaining stiffness of the bristles. When a polyamide such as Nylon 6,12 or Nylon 6,10 or blends of polyamides and polyesters are operated at temperatures of 220° C. and above, they lose their stiffness and ability to cut materials at the elevated temperatures such as those that typically occur under dry brushing applications. If a monofilament of a polyamide that has a higher temperature resistance, such as Nylon 6,6 (polyhexamethylene adipamide), is used as the bristle for a brush, the bristles fracture at the base of the brush after only a short period of operation since these polyamides are relatively brittle and have a low degree of flexibility.

There is a need for a monofilament containing an abrasive material that can be used for bristles of brushes that operate effectively at relatively high temperatures under dry brushing and polishing conditions. The polyamide monofilaments of the present invention operate effectively under such conditions.

SUMMARY OF THE INVENTION

The monofilament of this invention is a polyamide of polyhexamethylene adipamide oriented from 1.0–4.0 times its original length, has a diameter of 400–1600 microns and contains 2–20% by weight, based on the weight polyamide of the monofilament, of an alkyl aryl sulfonamide plasticizer and 5.0–40.0% by weight, based on the weight of the monofilament, of abrasive particles having a particle size of 10–400 microns. These monofilamnents are particularly useful as bristles used in brushes that are operated under dry conditions at relatively high temperatures.

DETAILED DESCRIPTION OF THE INVENTION

The polyamide monofilament is of polyhexamethylene adipamide which is plasticized with an alkyl aryl sulfonamide plasticizer and the monofilament is oriented in its original length from 1.0–4.0 times and has a diameter of 400–1600 microns and has dispersed therein 5–40% by weight, based on the weight of the monofilament, of abrasive particles. These monofilaments are useful for bristles in brushes that are operated under dry conditions and at temperatures in the range of 220–250° C. The bristles remain flexible at these elevated temperatures and retain their ability to brush and polish materials.

It is preferable for these monofilament to have a Fatigue Life of at least 50 minutes and preferably 50–500 minutes and above, as determined by "Impact Fatigue Test for Nylon Filaments" DuPont Test Method PP-0071 dated Jan. 14, 1998.

These monofilaments are particularly useful for the bristles of brushes that are used under dry conditions, in particular for brushes that are used to brush and/or polish metals, electronic parts and electronic circuit boards.

The polyamide used to form the monofilament preferably is Nylon 6,6 (polyhexamethylene adipamide) having a relative viscosity as determined by ASTM D-789-62T of 50–240 and preferably of 180–240.

A plasticizer is added to the polyamide so that it retains its flexibility under use conditions particularly when subject to elevated temperatures. The plasticizer is used in an amount of 2–20% by weight and preferably 5–15% by weight, based on the weight of polyamide of the monofilament. The plasticizer is an alkyl aryl sulfonamide, preferably where the alkyl group has 1–4 carbon atoms. Typical plasticizers are n-methyl benzene sulfonamide, n-ethyl benzene sulfonamide, n-propyl benzene sulfonamide, n-isopropyl benzene sulfonamide, n-isobutyl benzene sulfonamide and n-butyl benzene sulfonamide. One preferred plasticizer is n-butyl benzene sulfonamide since it is readily available and provides optimum flexibility to the monofilament.

The abrasive particles used in the monofilament have a particle size of 10–400 microns and preferably 20–350 microns. The particles are present in an amount of 5.0–40% by weight, based on the weight of the monofilament and preferably in an amount of 10.0–30.0%, by weight. The particles are of such a material that provides an abrasive to the monofilament to aid in brushing and polishing.

Preferred abrasive particles are as follows: silicon carbide, aluminum oxide, alumina zirconia, silicon dioxide, sodium aluminum silicate, cubic boron nitride, garnet, pumice, emery, mica, quartz, diamond, boron carbide, fused alumina, sintered alumina, and any mixtures thereof. Silicon carbide and aluminum oxide are preferred abrasives.

Process for Forming the Filament

In making the filament, a twin screw extruder typically is used such as a W & P (Werner and Pfleiderer) twin screw extruder, the polyamide in form of granules is fed from a feeder unit into the extruder either volumetrically or gravimetrically. The abrasive is fed from a separate feeder into the extruder as is the plasticizer and blended with the polyamide in the extruder at a temperature of 220–275° C. The blended mixture of polyamide, plasticizer and abrasive is then metered to a spin pack having a die plate and filaments of various shapes (not limited to solid round shapes) and sizes are produced. The shape of the filament cross section is determined by the shape of the holes in the die plate and may be any cross sectional shape, such as, round, oval, rectangular, triangular, any regular polygon or an irregular non circular shape and may be solid, hollow or contain multiple longitudinal voids in its cross sections. Each run of the extruder can produce any combination of cross-sectional shapes by using a die plate with various shaped holes. Strands of one or more diameters may be made at the same time by changing the size of the holes in the die plate.

After exiting the die plate, the bundle of filament strands is solidified in a water quench bath and then transported through a series of draw rolls for stretching of the filament strands. The filament strands are then transported through the heat set oven to heat set the filaments. The filament strands are then wound on a winder which is usually a drum or a spool. Optionally, the filaments can be surface treated to enhance or modify surface properties such as the coefficient of friction.

The following examples illustrate the invention. All parts and percentages are on a weight basis unless otherwise indicated.

EXAMPLES

Example 1

Monofilaments were prepared using Nylon 6,6 polyamide (polyhexamethylene adipamide) having a relative viscosity of 240, an abrasive material of silicon carbide having a particle size of 20–400 microns and a plasticizer of n-methyl benzene sulfonamide. A 30 mm W&P twin screw extruder was used having six zones heated to about 270° C. The polyamide, abrasive material and plasticizer were separately fed into the extruder and mixed. The resulting polymer mixture was metered into a spin pack with a die plate and a monofilament of 1000 microns was extruded into a water quench bath which was at room temperature and then transported over a series of draw rolls for stretching the monofilament and the monofilament was then passed through a heat set oven to heat set the monofilament and wound on a spool. Each of the monofilaments 1–10 had a abrasive content of 30% by weight. Monofilament No. 1 was the control and did not contain plasticizer. Monofilaments 2–10 each had a different plasticizer content as shown below:

| | |
|---|---|
| Monofilament No. 1 | 0% plasticizer |
| Monofilament No. 2 | 1.5% plasticizer |
| Monofilament No. 3 | 3.0% plasticizer |
| Monofilament No. 4 | 3.2% plasticizer |
| Monofilament No. 5 | 4.6% plasticizer |
| Monofilament No. 6 | 6.4% plasticizer |
| Monofilament No. 7 | 6.8% plasticizer |
| Monofilament No. 8 | 8.0% plasticizer |
| Monofilament No. 9 | 10.2% plasticizer |
| Monofilament No. 10 | 13.7% plasticizer |

(Percent plasticizer is based on the weight of the polyamide of the filament.)

The Fatigue Life of each of the above Monofilaments 1–10 was determined by aforementioned "Impact Fatigue Test for Nylon Filaments". In this test monofilaments 6.35 cm in length that have been stored at about 50% Relative Humidity and about 23° C. for 48 hours are mounted in four chucks spaced 90 degrees apart on a rotating head. The monofilaments are mounted in each chuck. The rotating head is attached to motor which is adjusted to run at 500 rpm. An impact bar is positioned for this size monofilament 12.9 mm from the rotating head so that each of the clusters of monofilaments in the chucks on the rotating head impacts the bar at the same point. The clusters of monofilaments are examined periodically, in this case every 10 minutes, and when 50% of the monofilaments fail the time is recorded. The longer the time the better the Fatigue Life of the monofilament. The results of this test are shown below:

| | Fatigue Life (50%) Failure Time (minutes) |
|---|---|
| Monofilament No. 1 | 45 |
| Monofilament No. 2 | 45 |
| Monofilament No. 3 | 60 |
| Monofilament No. 4 | 75 |
| Monofilament No. 5 | 60 |
| Monofilament No. 6 | 120 |
| Monofilament No. 7 | 148 |
| Monofilament No. 8 | 240 |
| Monofilament No. 9 | 488 |
| Monofilament No. 10 | 708 |

For a commercially acceptable monofilament a Fatigue Life of at least 50 minutes is required. The above results show that Monofilament No. 1 which does not contain plasticizer and Monofilament No. 2 which contains only 1.5% by weight plasticizer failed the Fatigue Life test. Whereas Monofilaments 3–10 which contained 3.0, 3.2, 4.6, 6.4, 6.8, 8.0, 10.2 and 13.7% plasticizer respectively, each had an acceptable Fatigue Life.

What is claimed is:

1. A monofilament consisting of a polyamide of polyhexamethylene adipamide having a relative viscosity of 180–240, oriented from 1.0–4.0 times its original length having a diameter of 400–1600 microns and containing 2–20% by weight, based on the weight of the polyamide of the monofilament, of an alkyl aryl sulfonamide plasticizer, and 5.0–40.0% by weight, based on the weight of the monofilament, of abrasive particles having a particle size of 20–350 microns.

2. The monofilament of claim 1 in which the alkyl group of the plasticizer has 1–4 carbon atoms.

3. The monofilament of claim 1 in which the plasticizer is n-butyl benzene sulfonamide.

4. The polyamide monofilament of claim 1 in which the abrasive is selected from the group consisting of particles silicon carbide, aluminum oxide, alumina zirconia, silicon dioxide, sodium aluminum silicate, cubic boron nitride, garnet, pumice, emery, mica, quartz, diamond, boron carbide, fused alumina, sintered alumina, and any mixtures thereof.

5. The polyamide monofilament of claim 1 in which the plasticizer is n-butyl benzene sulfonamide, and the abrasive is selected from the group consisting of particles silicon carbide, aluminum oxide, alumina zirconia, silicon dioxide, sodium aluminum silicate, cubic boron nitride, garnet, pumice, emery, mica, quartz, diamond, boron carbide, fused alumina, sintered alumina, and any mixtures thereof.

* * * * *